United States Patent [19]

Jansma

[11] Patent Number: 4,518,486

[45] Date of Patent: May 21, 1985

[54] CONCURRENT PRODUCTION OF TWO GRADES OF COKE USING A SINGLE FRACTIONATOR

[75] Inventor: John C. Jansma, Middleburg Heights, Ohio

[73] Assignee: The Standard Oil Company, Cleveland, Ohio

[21] Appl. No.: 401,810

[22] Filed: Jul. 26, 1982

Related U.S. Application Data

[63] Continuation-in-part of Ser. No. 219,651, Dec. 24, 1980. abandoned.

[51] Int. Cl.[3] ..... C10G 9/14

[52] U.S. Cl. ..... 208/131

[58] Field of Search ..... 208/78, 131, 53, 50

[56] References Cited

U.S. PATENT DOCUMENTS

| | | | |
|---|---|---|---|
| 2,775,549 | 12/1956 | Shea, Jr. | 208/50 |
| 3,617,480 | 11/1971 | Keel | 208/53 X |
| 3,930,985 | 1/1976 | Schieber et al. | 208/131 |
| 4,043,898 | 8/1977 | Kegler | 208/131 X |
| 4,066,532 | 1/1978 | Garcia | 208/131 X |
| 4,090,947 | 5/1978 | Satchell, Jr. | 208/50 X |
| 4,213,846 | 7/1980 | Sooter et al. | 208/131 X |

*Primary Examiner*—D. E. Gantz
*Assistant Examiner*—Glenn A. Caldarola
*Attorney, Agent, or Firm*—Bruce E. Harang; David J. Untener; Larry W. Evans

[57] ABSTRACT

An improved quality premium (needle) coke is produced from an aromatic concentrate as the feed and a non-coking feed supplement in lieu of recycle. The premium coker feed bypasses a fractionator, is combined with a non-coking feed supplement, heated in a furnace and charged to a coke drum. Vapors from the premium coking process are returned to a fractionator which is concurrently utilized in a regular grade coking operation. The premium coke thus formed is of a higher quality than coke made from conventional fractionator bottoms, and system costs are reduced by utilizing a single fractionator with concurrent production of regular and premium coke. A preferred embodiment shows additional benefits produced by a higher ratio of recycle to fresh feed to the coke drum during the last stage consisting of about 15 to 25 percent of the total fill cycle.

7 Claims, 1 Drawing Figure

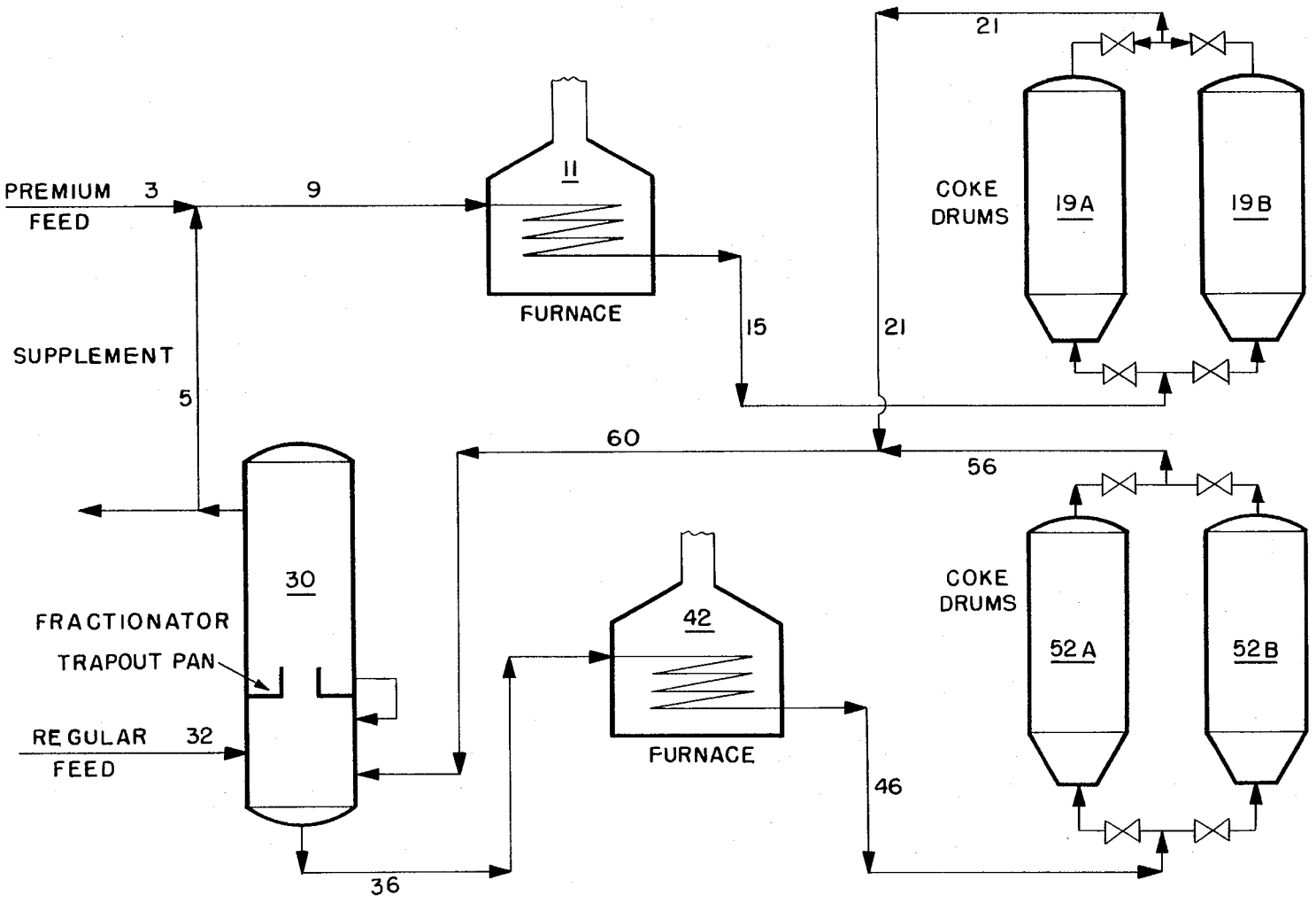
19B
19A
COKE DRUMS
21
21
52B
52A
COKE DRUMS
56
46
15
11
FURNACE
42
FURNACE
60
9
30
36
5
3
PREMIUM FEED
SUPPLEMENT
FRACTIONATOR TRAPOUT PAN
32
REGULAR FEED

CONCURRENT PRODUCTION OF TWO GRADES OF COKE USING A SINGLE FRACTIONATOR

CROSS-REFERENCE TO RELATED APPLICATIONS

This is a continuation-in-part of Ser. No. 219,651 filed on Dec. 24, 1980 now abandoned.

BACKGROUND OF THE INVENTION

1. Field of the Invention

This invention relates to a process for producing improved quality coke without contamination by recycle materials. In one embodiment, a high-quality premium (needle) coke is produced by using an aromatic concentrate as the feed and a non-coking feed supplement in lieu of recycle material from a fractionator.

More particularly, this invention concerns a process in which premium coker feed is combined with a non-coking feed supplement, fed directly to a furnace, heated and charged to a coke drum. Vapors from the premium coking process can be returned to a fractionator which is concurrently utilized in a regular grade coking operation. The premium coke thus formed is of a higher quality than coke made from conventional fractionator bottoms.

2. Discussion of the Prior Art

Production of premium petroleum coke of the quality needed to produce large graphite electrodes for use in electric arc furnaces remains more of an art than a predictable process, and improvements are constantly being sought. Regular (non-premium) petroleum coke is amorphous with a dark, spongy appearance and breaks into lumps of irregular shape. Premium coke is distinguished from regular or ordinary coke by its crystalline appearance and tendency to fracture into long, needle-like particles when crushed. After green coke preparation, coke calcination, electrode formation, and baking and graphitization, high-quality premium or needle coke has a low coefficient of thermal expansion (CTE), commonly below $7.0\times10^{-7}/°C$. Characteristics of premium coke are discussed in several references and patents including U.S. Pat. No. 4,130,475 to Cameron et al.

Delayed coking is a process in which a petroleum residue (or similar hydrocarbon fraction) is heated to a condition of thermal instability. Cokable materials are withdrawn from the bottom of a fractionator and pumped through a furnace at a high velocity to prevent coke formation on the inner walls of the furnace tubes. The high velocity is maintained in the furnace outlet piping and in the transfer line to the coke drums for the same reason. The coke drums are reservoirs that allow the combination of temperature and time to complete the thermal cracking initiated in the furnace. Vapors from the process exit the top of the coke drum and are usually returned to the coker fractionator. Delayed coking typically produces coke with a low volatiles content.

Two delayed coking methods for the production of premium and regular grade coke are common in the art. The first operates coke drums on a blocked-out (alternate) basis and uses a single fractionator for both feeds. The second method utilizes separate fractionators and related equipment for each coker system, premium and regular.

A common practice is to bring fresh feed into the fractionator column below the trapout pan where the feed is used to cool the entire coke drum vapor stream and condense the high-boiling fractions. It is also a common practice to retain a portion of the coke drum vapors as a condensed liquid (recycle) in the bottom of the fractionator where it is admixed with the fresh feed. These recycled coke drum vapors are at an appreciably higher temperature than the fresh feed and serve to preheat the fresh feed before it is sent to the furnace.

Regular grade operations are normally at low recycle ratios. Heat and material balance considerations in the fractionator result in a bottoms stream which is a combination of fresh feed and the condensed high-boiling materials from the drum overhead vapors. Recycle is used primarily to adjust the total feed carbon residue in regular grade coking operations.

Premium coking operations utilize a moderate to high ratio of recycle (condensed coke drum vapors) to fresh feed in the charge to the coke drums. The high recycle content in premium coker feed serves two functions: (1) providing a vaporizable material to generate satisfactory velocities in furnace tubes and transfer lines to prevent coke deposition prior to entry into the drum and, (2), serving as an energy carrier to the coke drums to minimize the difference between the coke drum temperature and furnace outlet temperature.

SUMMARY OF THE INVENTION

This invention is a process for the concurrent production of at least two grades of coke, e.g., regular and premium coke, using a single fractionator. In a preferred embodiment, the process comprises (a) combining a recycle-free premium feed with a non-coking feed supplement to form a premium coker charge,
(b) heating and introducing the charge to a premium coke drum,
(c) operating a single fractionator and withdrawing from it a regular grade coker feed,
(d) heating and charging the feed to a regular coke drum, and
(e) returning the overhead vapors from both premium and regular coke drums to the fractionator.

The inventive process allows the production of high-quality premium coke without contamination by recycle material or less cokable material and without using a separate fractionator. Additional improvements are obtained by varying the ratio of fresh feed to diluent material during the time of the drum fill cycle.

BRIEF DESCRIPTION OF THE DRAWINGS

The sole FIGURE, described below in greater detail, is a schematic flow diagram illustrating the concurrent production of high-quality premium and regular grade coke using a single fractionator.

DETAILED DESCRIPTION OF THE INVENTION

Coke Production With A Single Fractionator

The invention will permit any desired combination of concurrent coking operations in the same manner as the preferred operation of regular and premium coking processes. In its broad aspects, the process comprises (a) combining a recycle-free first feed with a non-coking feed supplement to form a first coker charge,
(b) heating and introducing the first charge to a first coke drum, (c) operating a single fractionator and withdrawing from it a second coker feed, (d) heating and charging the second feed to a second coke drum, and (e) returning the overhead vapors from both the first and second coke drums to the fractionator.

Although an embodiment with only two different grades of coke production is described in detail, it should be understood that additional coker feeds can be separately heated and charged to one or more additional sets of coke drums, with the overhead vapors from those drums being returned to the single fractionator. In this way the quality of such coker charge is not altered because it is not mixed with any cokable materials from the fractionator. A preferred embodiment is further described, wherein the first feed is suitable for regular grade coke, and the second feed is suitable for a premium grade coke.

Premium and Regular Coke Production

Referring to the FIGURE, cold premium fresh feed is introduced to the premium coking process through line 3. A non-coking feed supplement, such as light gas oil, is added from line 5 which preferably comes from the fractionator 30. The combined stream flows through line 9 to a coking furnace 11 where sufficient energy is added to enable production of the desired Volatile Combustible Material (VCM) level coke in the coke drums. Before reaching the coking furnace 11, materials in line 9 can optionally be preheated by conventional heat exchangers such as fractionator tower overhead streams or other tower streams (not shown). The temperature of materials at the furnace outlet and in transfer line 15 is about 940°–1000° F.

The heated coker charge in line 15 is directed to one of the premium coke drums 19A or 19B. Coke drum overhead vapor line 21 contains the non-coking feed supplement, coking products and lower-boiling fresh feed. Line 21 connects with line 60 which flows to fractionator 30, where it enters preferably at a point below the trapout pan.

The portion of the process for producing regular grade coke begins at fractionator 30. Regular grade feed, e.g. crude oil vacuum bottoms, is fed to fractionator 30 through line 32 where it is heated by mixture with coke drum overhead vapors entering through line 60. The resultant tower bottoms consisting of condensed recycle from both coking operations and all but the the low-boiling fraction of the regular coker feed is withdrawn through line 36 to the regular grade coking furnace 42. The heated coker charge flows through line 46 into one of regular grade coke drums 52A or 52B. Overhead vapors from the regular coke drums exit via line 56 where they are combined with line 21 to be returned to the fractionator 30. It is also preferred to add a conventional quench system and pressure reduction valve (not shown) in line 21 at a point before line 21 joins with 60 in order to reduce the relatively higher temperatures and pressures of materials exiting from the premium coke drums to conditions similar to those found in line 56. This will prevent coking and clogging of line 60.

Once-Through Premium Coking

The invention is especially beneficial for the production of high quality premium coke from the recycle-free first coker charge, regardless of what additional grade of coke is concurrently produced.

Any premium feed which is capable of forming needle or graphite coke can be used in this invention. Although "premium" is often loosely defined to mean coke having one or more qualities which make it superior to regular coke, for the purposes of this invention "premium" means having qualities that allow ultimate production of needle coke having a CTE below $7.0\times10^{-7}$/°C. The term "regular" is used to denote lower-quality coke, especially coke which cannot meet the above specifications. A preferred feed for the premium coker operation is an aromatic concentrate boiling from 600° to 1000° F., most preferably obtained from fluid catalytic cracking. Fluid catalytic cracking is a process which cracks high-boiling gas oils (nominally boiling between 650° and 1050° F.) into lower-boiling products having enhanced commercial value. The highly aromatic concentrate is preferably directly withdrawn from near the bottom of the catalytic cracker main column.

Such premium feeds form coke primarily by the initial condensation of the polynuclear aromatics followed by cracking reactions. In contrast, regular grade coking forms coke primarily by cracking asphaltenes or resins. Feeds that are rich in aromatics tend to form needle coke which is preferred for the manufacture of electrodes having a low CTE for use in electrometallurgy. The denomination of needle coke is due to the elongated appearance of the coke particles which results from the orientation of the crytallite structure during coking. Such crystallites assume an elongate elliptical form being connected in series along the major dimensions.

In prior art processes, recycle material is typically added to produce a recycle to fresh feed volume ratio generally ranging from about 0.1–0.5:1 for regular grade coke, and up to about 2:1 for premium coke production. The inventive process uses no recycled feed for the premium coking operation, although a portion of the feed supplement (which does not form coke) can be reused in a preferred embodiment. Recycled feed molecules are more refractory than the fresh feed molecules that form coke on a single-pass basis. Although recycled feeds will form coke, they will not do so as readily as fresh feed. The difference in coking rate is thought to cause a faulty lattice formation (needle structure) in the coke which results in a higher (lower quality) CTE. Presence of recycle will have a harmful effect on the overall needle coke quality.

In a coking operation which utilizes the features of this invention, a premium coker feed as described above is obtained from a source where it has not been mixed with a recycled feed stream or other less cokable materials. For the purposes of this invention, recycle-free shall mean that the the premium coker feed must bypass the fractionator. The fresh premium feed is diluted with a non-coking feed supplement such as a light gas oil draw from the coker fractionator to produce a recycle-free premium feed, and this combined charge is fed to a conventional furnace. Light gas oil is a hydrocarbon fraction boiling between about 400° to 600° F., and will not form coke at conditions encountered during conventional delayed coking operations. Heavy gas oils typically boil above about 600° F. Other feed supplements that can be used include, for example, virgin naphtha and virgin light gas oils boiling between about 400° to 600° F. The amount of feed supplement will depend on the quality of the premium feed but should be an amount sufficient to prevent premature coking of the charge in the furnace 11 and transfer line 15 to the coke drum. The ratio of feed supplement to fresh premium feed is similar to the ratio of recycle to fresh feed in conventional premium coking operations. This ratio is usually less than 2:1, and preferably between about 0.5–1.5:1. Optimum ratios can be determined by incrementally increasing or decreasing the amount of non-coking feed supplement in the furnace charge.

The heated charge is then withdrawn from the coking furnace 11 and introduced into one or more coke drums 19 of a type known in the art. The coke drums are operated at a pressure between about 30 and 150 psig, preferably about 90. The overhead temperature of the drums is typically between about 850° and 950° F., and preferably about 900° F. An overhead vapor stream is withdrawn from the coke drums and introduced to the fractionating column, preferably at a point below a trapout pan.

The regular grade coke feed is introduced into the fractionating column 30 in a conventional fashion. A cokable bottoms fraction is then withdrawn from the fractionator, passed through a furnace 42, and fed to one or more drums 52 which will produce regular grade coke. The overhead vapors are added to return line 60 to be recycled to the fractionator 30. The operation of the portion of the inventive process for regular coking (referred to in the FIGURE with numbers of 30 or above) is at conventional conditions well known to those in the art. Because of the addition of the hot materials entering through lines 21 and 60 to fractionator 30, external heat requirements will be lowered.

Feed Ratio Variation

An additional embodiment relates to a method of producing coke in which the ratio of feed to diluent is varied during the course of filling the coke drum.

In actual industry operation more than one coke drum is provided so that as one drum is being filled, the coke in another drum is being cooled, cut, and removed. These operations are usually scheduled to take the same amount of time, allowing regular cycles of about 24 hours each. Other schedules are possible depending upon the number of drums in the set, and the length of the fill cycle can be varied accordingly.

Since the drum is continuously accumulating coke during the fill cycle, the coker feed which is deposited near the bottom is subjected to the coke drum temperature for a longer period of time than is the feed which is added later. Because of the relationship of time, temperature, and pressure, the first-formed coke is of higher quality than that deposited at the top of the coke drum. On occasion the presence of this top coke causes a downgrading of the quality specification of the entire coke mass.

Coke of improved average quality can be produced from a mixture of fresh feed and diluent by a process which comprises introducing the mixture to a coke drum during a first stage consisting of about 75 to 85 percent of the total fill period increasing the ratio of diluent to fresh feed after completion of the first stage, and introducing the resulting mixture having a higher ratio of diluent to fresh feed to the coke drum during a last stage consisting of about 15 to 25 percent of the total fill period.

For the purposes of this invention, diluent is defined as a material which is added to the coker fresh feed to prevent premature coking of the feed and to serve as a heat carrier. As discussed above, this diluent may consist of recycle materials from the fractionator bottoms which will form at least some coke at the process conditions. Alternatively, the diluent may consist solely of non-coking material such as light gas oils.

Previously, the ratio of diluent to fresh feed was kept nearly constant over the entire time of the drum fill cycle. If minor variations were made, they were to adjust the overall rate of filling the drum or to ensure that the feed did not coke prematurely (before entering the drum). The actual ratio of diluent to feed is determined by the properties of the fresh feed and the diluent, and by the operating conditions of the furnace and related coker unit equipment. In order to illustrate the embodiment, a commonly used ratio of one part diluent per part fresh feed will be discussed. Other ratios are, of course, possible.

Less diluent and more fresh feed can be used during the first stage of the drum fill, followed by more diluent and less fresh feed during the last stage. Because the coker feed during the first stage has a relatively higher amount of cokable materials and remains in the drum for a longer period of time, it will tend to form a high quality coke. During the last stage near the end of the drum fill, more diluent and less feed is used. Although a certain amount of inferior quality top coke is inevitably made, the average quality of the entire coke batch is improved.

For purposes of this invention, the first stage of the coker drum fill is defined as the period from the starting point (time zero) until about 75 to 85 percent of the scheduled fill time has elapsed. As an example, if a coker drum was on a 24 hour fill cycle, the first stage would consist of approximately the first 18 to 20 hours.

The last stage is defined as the period following the first stage and lasting until the end of the fill cycle, or the final 15 to 25 percent of the scheduled fill time. Continuing the example above, the last stage of a 24 hour cycle would consist of the last 4 to 6 hours.

At the end of the first stage of the drum fill, the feed ratio is changed to increase the ratio of diluent to fresh feed. This change can be accomplished abruptly or gradually, but it is preferred to accomplish the feed ratio change within about 5 percent of the fill schedule time, or within about 1 hour of a 24 hour fill cycle. A gradual change of feed ratios will allow the process operator to maintain the desired temperatures in furnace, transfer lines, and other coker equipment.

The feed ratios can vary widely, but the usual ratios of diluent to fresh feed for the first stage will range from about 0.2:1 to about 2:1, preferably about 0.6:1 to about 1:1. The last stage will have ratios of about 1:1 to 5:1, preferably about 2:1 to 3:1.

The ratio chosen for the first stage can be any conventional ratio as taught in the art. Because the ratio of diluent to fresh feed will be increased for the last stage, however, it is advantageous that the first stage have a ratio that is slightly lower than normal. This will allow a relatively larger amount of fresh feed to enter the coke drum during the first stage of the fill, where it can remain for a time sufficient to form high quality coke.

It is also preferred to adjust the fill rate so that a slightly higher volume of feed per hour enters the coke drum during the first stage. The rate of fill can then be decreased during the last stage so as not to overfill the drum.

The actual choice of feed ratios for each of these stages will depend upon the characteristics of the particular feedstock as well as the other operating conditions of the coker. For example, the amount of diluent or heated diluent must be sufficient to maintain a furnace outlet temperature that will in turn result in a sufficiently high temperature in the coke drums which is necessary to produce a quality coke. However, the furnace outlet temperature should not be high enough to result in significant premature coking in the transfer lines from the furnace to the coke drum. Optimal performance is achieved when the coking units do not require decoking more often than the scheduled annual shutdown for maintenance.

In actual operation of the coking process using several coke drums, a second drum is being readied during the last stage of fill for the first drum. This preparation consists of heating the second drum and passing hot vapors through it. During the initial heating of the off-line drum, condensed gas oils can be pumped from the coking system as wet condensate. Because the heating of the second drum coincides with the high diluent period (last stage) of the first drum, there will be a large demand for hot diluent material and an external diluent supplement may be required.

Although only a few embodiments have been specifically described, many modifications can be made without departing from the spirit and scope of the invention. These modifications are intended to be included within the scope of this invention, which is to be limited only by the following claims:

I claim:

1. A process for the concurrent production of both regular and premium coke using a single fractionator, the process comprising (a) combining a recycle-free premium feed with a non-coking feed supplement to form a premium coker charge, (b) heating and introducing the charge to a premium coke drum to form coke and overhead vapors, (c) operating a single fractionator and withdrawing from it a regular grade coker recycle feed, (d) heating and charging said regular grade coker feed to a regular coke drum, to form coke and overhead vapors (e) passing the overhead vapors from both premium and regular coke drums to the fractionator.

2. The process of claim 1 in which the premium coke feed is an aromatic concentrate boiling from 600° to 1000° F.

3. The process of claim 2 in which the aromatic concentrate is obtained from a fluid catalytic cracker.

4. The process of claim 3 in which the non-coking feed supplement is a light gas oil draw from a fractionator.

5. The process of claim 4 in which the supplement to fresh feed ratio is between about 0.5–1.5:1.

6. The process of claim 1 in which the premium coker charge is introduced to the first coke drum by a process comprising:

(a) introducing the premium coker charge to the premium coke drum during a first stage consisting of about 75 to 85 percent of the total fill period, (b) increasing the ratio of non-coking feed supplement to fresh feed after completion of the first stage, and (c) introducing the resulting mixture having a higher ratio of non-coking hydrocarbonaceous feed supplement to fresh feed to the coke drum during the last stage consisting of about 15 to 25 percent of the total fill period.

7. The process of claim 6 in which the ratio of non-coking hydrocarbonaceous feed supplement to fresh feed for the first stage is from about 0.2:1 to about 2:1 and the ratio for the last stage is about 1:1 to 5:1.

* * * * *